US008117778B2

(12) United States Patent
Clark et al.

(10) Patent No.: US 8,117,778 B2
(45) Date of Patent: Feb. 21, 2012

(54) PROCESSES AND SYSTEMS FOR MONITORING ENVIRONMENTS OF PROJECTILE WEAPONS

(76) Inventors: Robert Bernard Iredale Clark, Bodmin (GB); Paul Andrew Leitner-Wise, Alexandria, VA (US); David Gessel, Oakland, CA (US)

( * ) Notice: Subject to any disclaimer, the term of this patent is extended or adjusted under 35 U.S.C. 154(b) by 362 days.

(21) Appl. No.: 12/353,602

(22) Filed: Jan. 14, 2009

(65) Prior Publication Data

US 2009/0287455 A1 Nov. 19, 2009

Related U.S. Application Data

(63) Continuation-in-part of application No. 11/746,711, filed on May 10, 2007, now abandoned.

(51) Int. Cl.
*F41A 9/53* (2006.01)

(52) U.S. Cl. ..... 42/1.01; 42/1.03

(58) Field of Classification Search ..... 42/1.01–1.05; 89/28.05

See application file for complete search history.

(56) References Cited

U.S. PATENT DOCUMENTS

| | | | | |
|---|---|---|---|---|
| 2,306,747 | A | 12/1942 | Ojalvo | |
| 2,984,104 | A | 5/1961 | Levine | |
| 3,127,768 | A | 4/1964 | Mason | |
| 3,453,882 | A | 7/1969 | Kirkendall | |
| 3,552,053 | A | 1/1971 | Jarvis | |
| 3,785,261 | A * | 1/1974 | Ganteaume | 396/426 |
| 3,792,638 | A | 2/1974 | Cox | |
| 3,902,368 | A | 9/1975 | Hasenbein | |
| 3,914,996 | A | 10/1975 | Davis | |
| 4,001,961 | A | 1/1977 | Johnson | |
| 4,146,987 | A | 4/1979 | Hudson | |
| 4,352,665 | A | 10/1982 | Kimble | |
| 4,379,405 | A | 4/1983 | Engeler | |
| 4,486,710 | A | 12/1984 | Schmidt | |
| 4,541,191 | A * | 9/1985 | Morris et al. | 42/1.01 |
| 4,928,523 | A | 5/1990 | Muhrer | |
| 5,005,307 | A | 4/1991 | Horne | |
| 5,303,495 | A * | 4/1994 | Harthcock | 42/84 |
| 5,349,853 | A * | 9/1994 | Oehler | 73/167 |
| 5,402,678 | A | 4/1995 | Fritz | |
| 5,406,730 | A | 4/1995 | Sayre | |
| 5,566,486 | A | 10/1996 | Brinkley | |
| 5,642,581 | A | 7/1997 | Herold | |
| 5,659,148 | A | 8/1997 | Isgen | |
| 5,918,304 | A | 6/1999 | Gartz | |
| 6,094,850 | A | 8/2000 | Villani | |
| 6,311,682 | B1 | 11/2001 | Rice | |
| 6,378,367 | B1 | 4/2002 | Dilz | |
| 6,449,892 | B1 | 9/2002 | Jenkins | |
| 6,590,386 | B1 | 7/2003 | Williams | |

(Continued)

FOREIGN PATENT DOCUMENTS

| | | |
|---|---|---|
| DE | 3911804 | 10/1990 |

(Continued)

*Primary Examiner* — Michael Carone
*Assistant Examiner* — Samir Abdosh

(57) ABSTRACT

Processes and systems are disclosed for recording data relating to a shot by a projectile weapon. Environment data occurring prior to data indicating the occurrence of a shot by the projectile weapon is retained for subsequent evaluation. Such environment data includes, but is not limited to, ambient audio data, video data produced by a video camera associated with the projectile weapon, GPS data representing locations of the projectile weapon, electronic compass data representing orientations of the projectile weapon and acceleration data representing accelerations of the projectile weapon.

9 Claims, 9 Drawing Sheets

U.S. PATENT DOCUMENTS

| | | | | |
|---|---|---|---|---|
| 6,615,814 | B1 | 9/2003 | Rice | |
| 6,643,968 | B2 | 11/2003 | Glock | |
| 6,817,239 | B2 | 11/2004 | Glock | |
| 6,925,742 | B1 | 8/2005 | Van Zyl | |
| 7,100,437 | B2 * | 9/2006 | Johnson et al. | 73/167 |
| 7,143,644 | B2 | 12/2006 | Johnson | |
| 7,234,260 | B2 | 6/2007 | Acarreta | |
| 7,234,262 | B2 * | 6/2007 | Smith | 42/84 |
| 7,292,262 | B2 * | 11/2007 | Towery et al. | 348/61 |
| 2003/0061753 | A1 | 4/2003 | Glock | |
| 2003/0167909 | A1 | 9/2003 | Matter | |
| 2006/0042142 | A1 | 3/2006 | Sinha | |
| 2006/0156804 | A1 | 7/2006 | Shipman | |
| 2008/0016744 | A1 | 1/2008 | Joannes | |
| 2008/0282595 | A1 * | 11/2008 | Clark et al. | 42/1.01 |
| 2008/0289485 | A1 | 11/2008 | Quinn | |
| 2010/0251586 | A1 * | 10/2010 | Packer et al. | 42/1.01 |
| 2010/0281725 | A1 * | 11/2010 | Arbouw | 42/1.02 |

FOREIGN PATENT DOCUMENTS

| | | |
|---|---|---|
| DE | 4022038 | 1/1992 |
| DE | 4417545 | 11/1995 |
| EP | 283524 | 9/1988 |
| JP | 10089894 | 4/1998 |
| JP | 11051785 | 2/1999 |

* cited by examiner

PROCESSES AND SYSTEMS FOR MONITORING ENVIRONMENTS OF PROJECTILE WEAPONS

This application is a continuation-in-part of U.S. patent application Ser. No. 11/746,711, filed May 10, 2007 now abandoned, entitled Device for Recording and Displaying Data from the Firing of Small-Arms, which is hereby incorporated herein by reference in its entirety.

BACKGROUND

Processes and systems are disclosed for monitoring the environment of a projectile weapon, such as small arms, artillery and projectile weapons mounted on weapons platforms, such as tanks, self-propelled artillery, armored personnel carriers and aircraft.

Many have proposed devices to monitor the number of rounds fired by an automatic or semi-automatic firearm. Generally speaking, the proposed devices are either used to record the number of rounds fired for later study or meant to warn the user before the magazine of the firearm becomes empty. A few devices have been proposed that record the time and date when a weapon was fired, particularly for use in criminal investigations. The proposed devices suffer from various shortcomings, such as an inability to provide amounts and types of information that are adequate for reconstructing a crime scene or a battlefield firefight.

DISCLOSURE

For this application the following terms and definitions shall apply:

The term "data" as used herein means any indicia, signals, marks, symbols, domains, symbol sets, representations, and any other physical form or forms representing information, whether permanent or temporary, whether visible, audible, acoustic, electric, magnetic, electromagnetic or otherwise manifested. The term "data" as used to represent predetermined information in one physical form shall be deemed to encompass any and all representations of corresponding information in a different physical form or forms. The term "database" as used herein means an organized body of related data, regardless of the manner in which the data or the organized body thereof is represented. For example, the organized body of related data may be in the form of one or more of a table, a map, a grid, a packet, a datagram, a frame, a file, an e-mail, a message, a document, a report, a list or in any other form.

The term "network" as used herein includes both networks and internetworks of all kinds, including the Internet, and is not limited to any particular network or internetwork.

The terms "first", "second", "third", "primary" and "secondary" are used to distinguish one element, set, data, object, step, process, activity or thing from another, and are not used to designate relative position or arrangement in time, unless otherwise stated explicitly.

The terms "coupled", "coupled to", and "coupled with" as used herein each mean a relationship between or among two or more devices, apparatus, files, circuits, elements, functions, operations, processes, programs, media, components, networks, systems, subsystems, and/or means, constituting any one or more of (a) a connection, whether direct or through one or more other devices, apparatus, files, circuits, elements, functions, operations, processes, programs, media, components, networks, systems, subsystems, or means, (b) a communications relationship, whether direct or through one or more other devices, apparatus, files, circuits, elements, functions, operations, processes, programs, media, components, networks, systems, subsystems, or means, and/or (c) a functional relationship in which the operation of any one or more devices, apparatus, files, circuits, elements, functions, operations, processes, programs, media, components, networks, systems, subsystems, or means depends, in whole or in part, on the operation of any one or more others thereof.

The terms "communicate," "communicating" and "communication" as used herein include both conveying data from a source to a destination, and delivering data to a communications medium, system, channel, network, device, wire, cable, fiber, circuit and/or link to be conveyed to a destination. The term "communications" as used herein includes one or more of a communications medium, system, channel, network, device, wire, cable, fiber, circuit and link.

The term "processor" as used herein means processing devices, apparatus, programs, circuits, components, systems and subsystems, whether implemented in hardware, software or both, and whether or not programmable. The term "processor" as used herein includes, but is not limited to one or more computers, hardwired circuits, signal modifying devices and systems, devices and machines for controlling systems, central processing units, programmable devices and systems, field programmable gate arrays, application specific integrated circuits, systems on a chip, systems comprised of discrete elements and/or circuits, state machines, virtual machines, data processors, processing facilities and combinations of any of the foregoing.

The terms "storage" and "data storage" as used herein mean one or more data storage devices, apparatus, programs, circuits, components, systems, subsystems, locations and storage media serving to retain data, whether on a temporary or permanent basis, and to provide such retained data.

FIG. 1 is a block diagram of a first embodiment of a system for detecting a shot by a projectile weapon FIG. 2 is a diagram illustrating X, Y and Z axes for measuring accelerations caused by a shot;

FIG. 3 schematically illustrates a circular buffer storing acceleration data;

FIG. 4 is a flow chart of a main module of an embodiment of a shot detection process implemented by a system such as that illustrated in FIG. 1;

FIG. 5 provides hypothetical time charts of data produced by accelerometers of the FIG. 1 embodiment;

Figure 1:
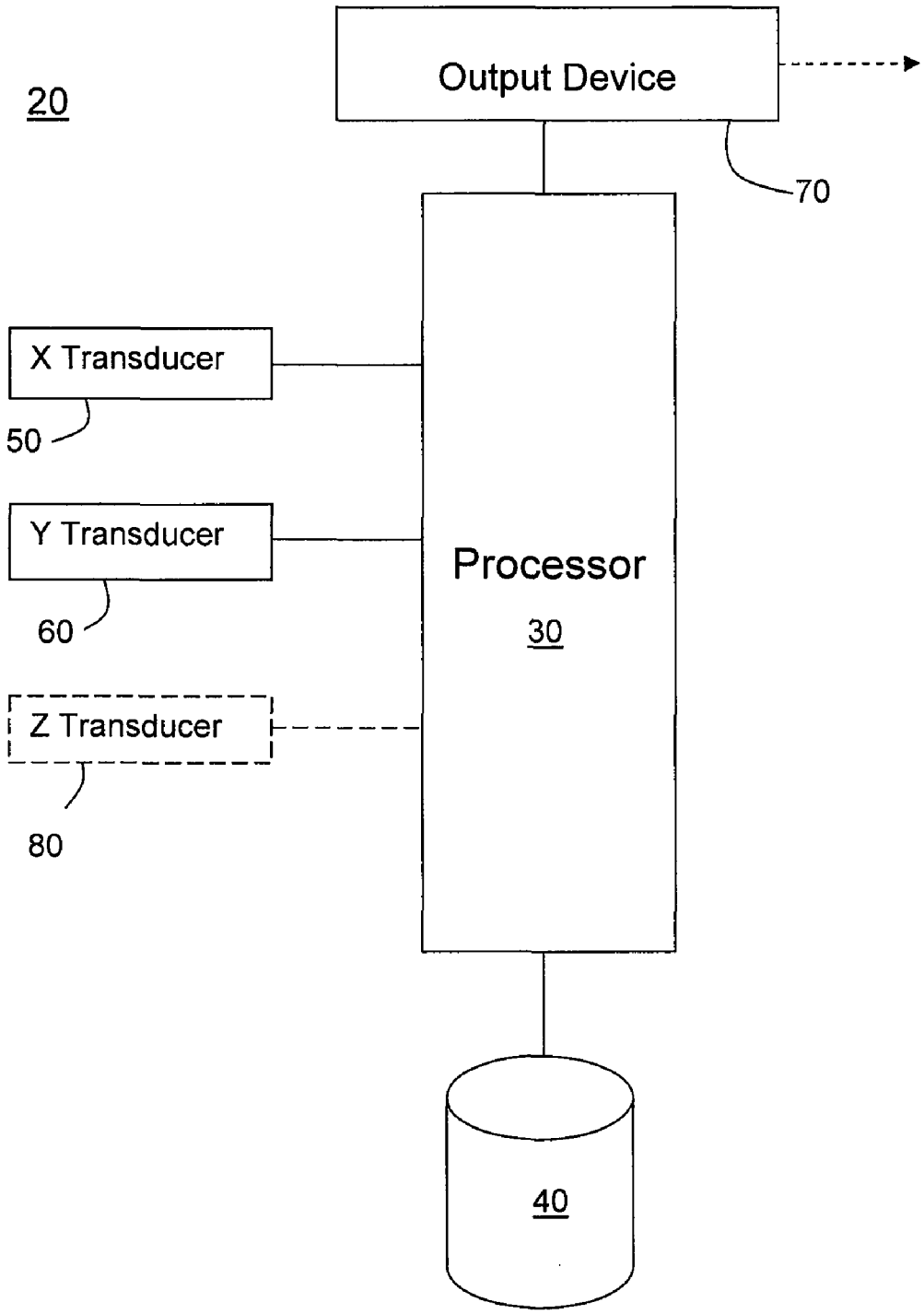
Figure 8:
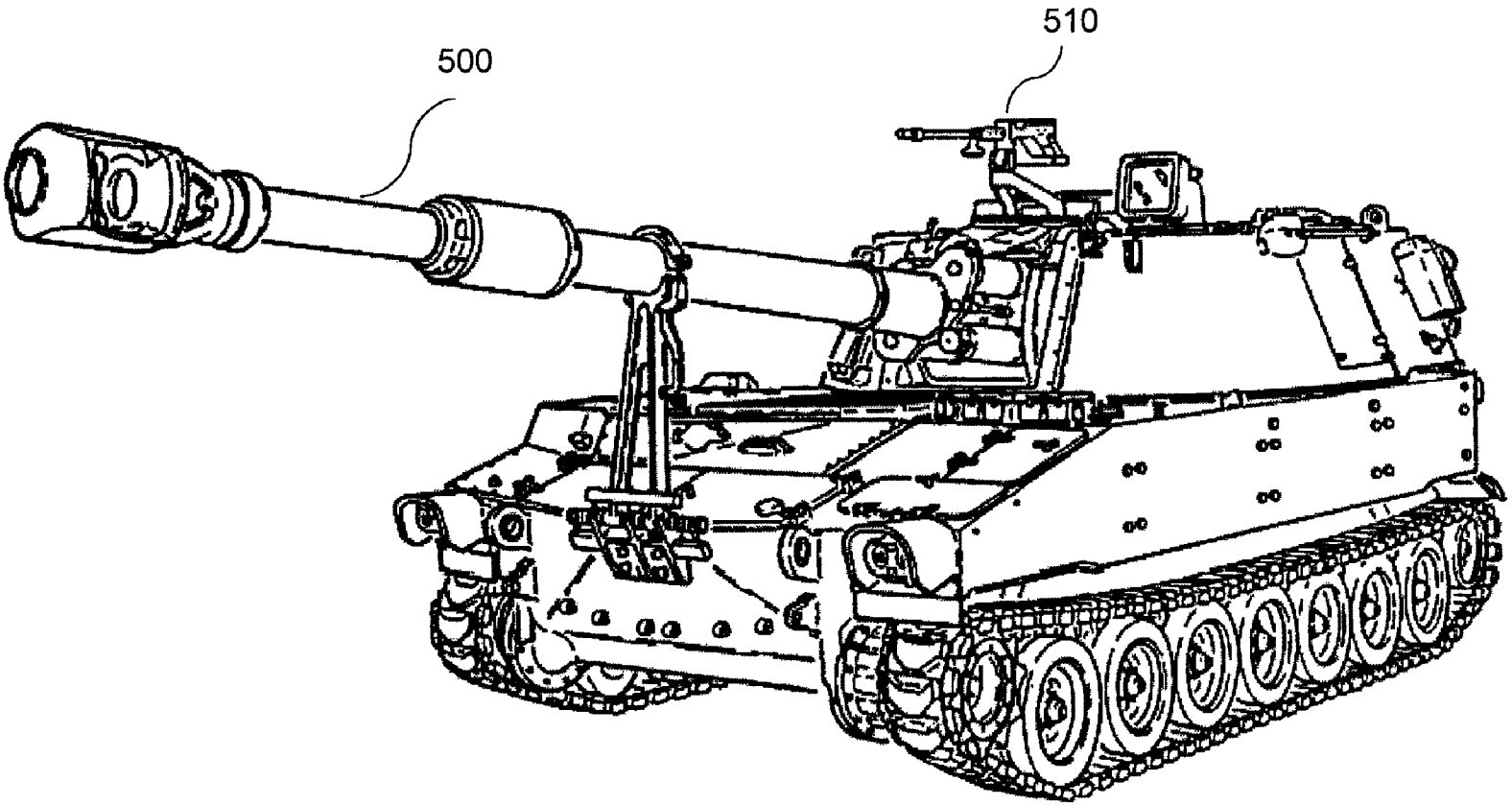
Figure 9:
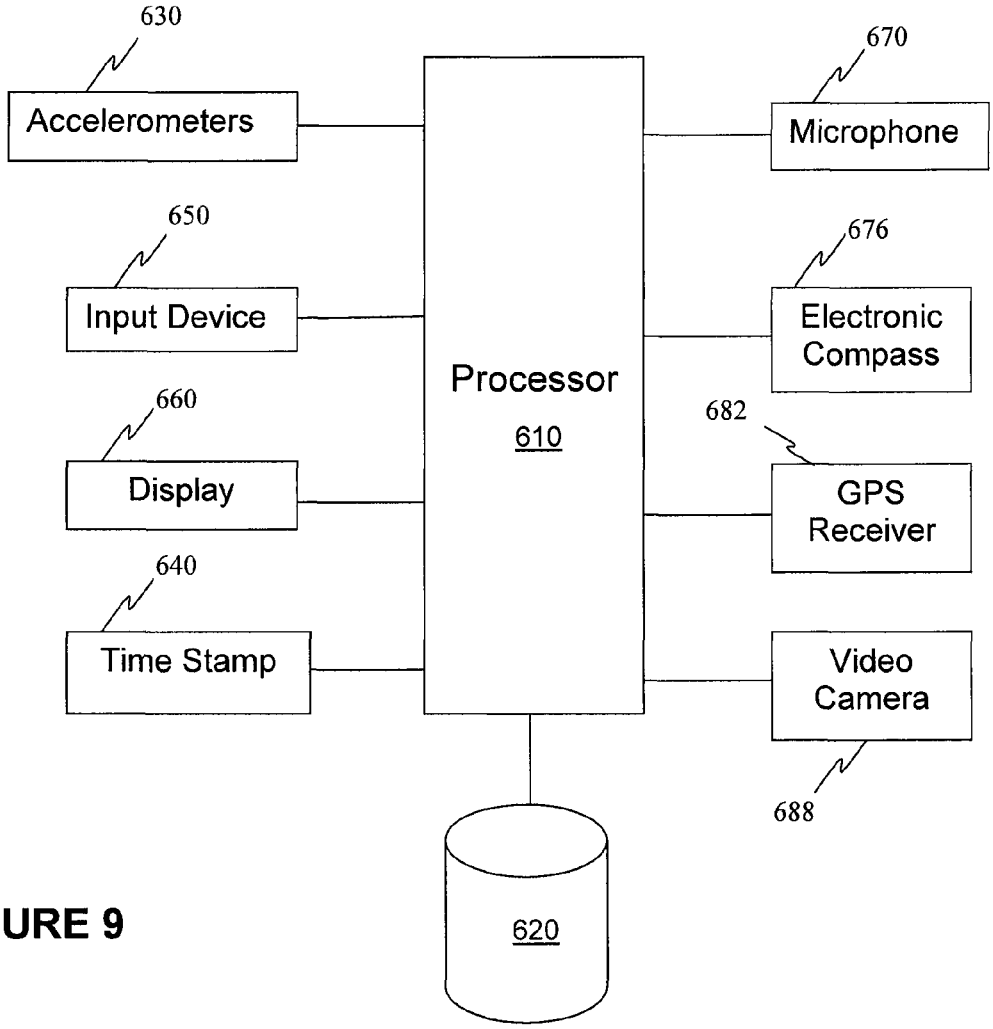

FIG. 8 illustrates an M109 Self-Propelled Howitzer mounting multiple projectile weapons to be monitored by systems of the kind illustrated in FIG. 1; and FIG. 9 is a block diagram of a system for recording data relating to a shot by an associated projectile weapon A process for recording data relating to a shot by a projectile weapon is disclosed. The process comprises temporarily storing in storage environment data related to an environment of the projectile weapon associated with time data representing a time of occurrence of the environment data; removing the temporarily-stored environment data from the storage associated with a time of occurrence that is more than a predetermined time period older than a current time; receiving shot data representing a shot made by the projectile weapon; and in response to the shot data, storing a record of at least a portion of the temporarily-stored environment data longer than the predetermined time period.

A system for recording data relating to a shot by a projectile weapon is disclosed. The system comprises at least one input; a processor coupled to the at least one input to receive environment data related to an environment of the projectile weapon; and storage; the processor being configured to temporarily store the environment data in the storage associated with time data representing a time of occurrence of the environment data; to remove the temporarily-stored environment data from the storage associated with a time of occurrence that is more than a predetermined time period older than a current time; to receive shot data representing a shot made by the projectile weapon from the at least one input; and in response to the shot data, storing a record of at least a portion of the temporarily-stored environment data in the storage longer than the predetermined time period.

A process for recording data relating to a shot by a projectile weapon is disclosed. The process comprises storing environment data related to an environment of the projectile weapon in a buffer and associated with time data representing a time of occurrence of the environment data; receiving shot data representing a shot made by the projectile weapon; and in response to the shot data, storing at least a portion of the environment data in the buffer in storage other than the buffer.

A system for recording data relating to a shot by a projectile weapon is disclosed. The system comprises at least one input; a processor; a buffer and storage; the buffer being coupled with the at least one input to receive environment data related to an environment of the projectile weapon and operative to store the environment data associated with time data representing a time of occurrence of the environment data; the processor being coupled with the at least one input to receive shot data representing a shot made by the projectile weapon and operative, in response to the shot data, to store at least a portion of the environment data from the buffer in the storage.

A process for recording data relating to a shot by a projectile weapon is disclosed. The process comprises receiving shot data representing a shot made by the projectile weapon; and in response to the shot data, storing data representing occurrences prior to the shot data.

In certain embodiments, data on firearms usage is collected by a device which is mounted to the firearm so as to be able to sense at least an impulse in the firearm due to firing. The device has a means to mount the electronics onto or within a gun so that it is protected from the environment; an impulse sensor; a processor and memory. The processor accepts impulse signals from the detector, and uses vector analysis to discriminate a true shot by comparing the signal from the impulse detector to a stored representation of a true shot in amplitude and direction. The stored information may comprise any combination of temperature, firing rate, firing intervals and time data for immediate display or subsequent analysis, and, optionally, information identifying the weapon to which the device is attached. In addition to a visual display screen, in certain ones of such embodiments, the device has an interface to transfer data from the device to a computer or other data collection device.

In certain embodiments, an incrementally variable cost, electronic data capture system is provided that records, stores and gives a real-time visual read-out of each shot discharged by a firearm allowing the user to instantly know how many rounds they have fired, when the firearm requires reloading and the lifetime usage of the firearm, to be downloaded to a personal computer or data collection device via a USB port or similar interface. Software stored in the system allows it to be upgraded to support additional data retrieval functions as well as alert the operator to any anomalies or variations between the rounds fired. The device is configured to distinguish between dry-firing, rough-handling and actual ammunition discharge and recognize magazine changes, automatically resetting itself to a default round capacity preset by the weapon's operator. The device can be mounted on any existing firearm from a pistol to a crew-served weapon or alternatively, can be integrated into the electronics suite of a weapons platform.

FIG. 1 is a block diagram of certain embodiments of a system 20 for detecting a shot by a projectile weapon. The system 20 comprises a processor 30, storage 40, an X transducer 50, a Y transducer 60 and an output device 70. In certain ones of such embodiments, the system 20 comprises a Z transducer 80.

Figure 2:
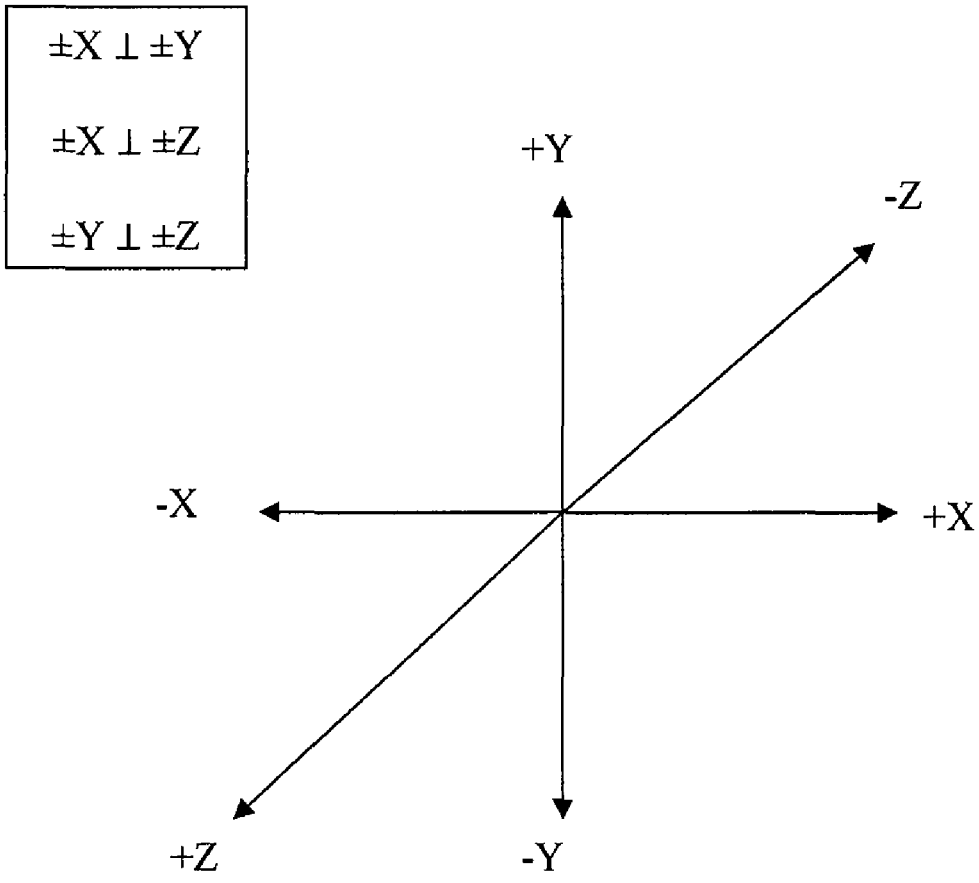

In certain ones of such embodiments, the X transducer, the Y transducer and the optional Z transducer comprise accelerometers arranged to detect accelerations in respectively different, orthogonal axes, as illustrated in FIG. 2. In certain ones of such embodiments, the X transducer is arranged relative to a projectile weapon so that it detects accelerations parallel to a longitudinal axis of a barrel of the projectile weapon and to an accelerating projectile within the barrel. The Y transducer thus detects accelerations along an axis perpendicular to the barrel. The optional Z transducer, if included in the system 20, then will detect accelerations along a further axis perpendicular to the barrel and perpendicular to the axis along which accelerations are detected by the Y transducer. The orthogonal arrangement of the axes is advantageous since the accelerometers thus detect all accelerations of the projectile weapon and/or its platform, either in a plane if only X and Y transducers are included, or in all three dimensions if the optional Z transducer is included as well.

Figure 3:
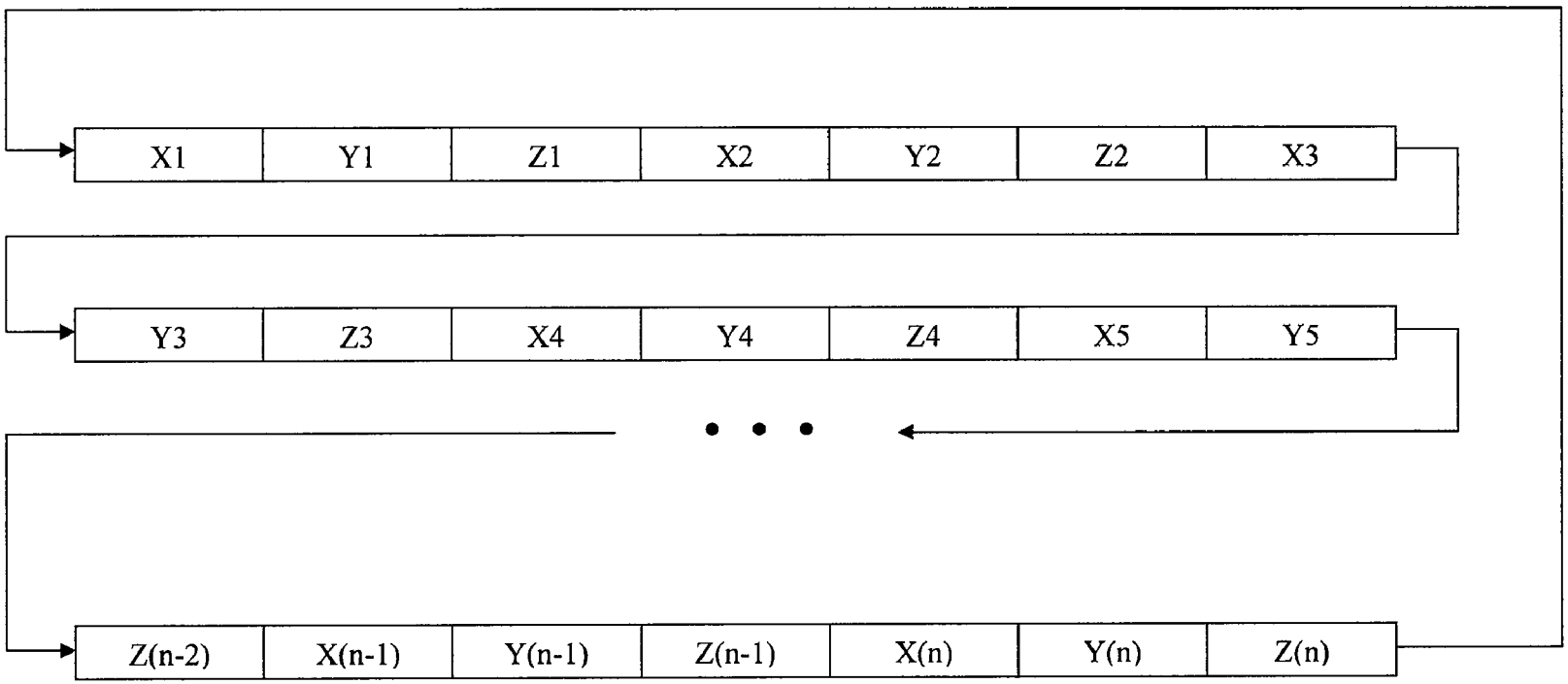

Each of the transducers has an output coupled with the processor 30. Data output from the X and Y transducers, and the optional Z transducer (if included), are converted to digital form, either by A/D converters integrated with the transducers, or by at least one A/D converter of the processor 30. Processor 30 temporarily stores the data received from the transducers in a circular buffer, which is either integrated with processor 30, or implemented by storage 40 which is coupled with processor 30. FIG. 3 schematically illustrates a circular buffer storing data received from transducers X, Y and Z for (n) time periods. For each time period (i), the circular buffer stores at least three values, a transduced value X(i) produced by the X transducer, another transduced value Y(i) produced by the Y transducer and a further transduced value Z(i) produced by the Z transducer. Each of these transduced values is advantageously stored as a single word (whether as 4, 8, 16 or other bit-length words), with or without time period data representing a time period in which the data was produced. Where the time periods all have the same duration and the circular buffer is implemented by storing the data X1, Y1, Z1, X2, Y2 . . . X(n), Y(n), Z(n) in successive memory locations and returning to the location of data X1 from the location of the data Z(n), the time period of each data record can be inferred from its memory location and a pointer to a memory location representing a current time period. When the data of (n) time periods have been stored in the circular buffer, it begins to overwrite previously stored data by storing data for the current time period at the locations of the data stored for the $n^{th}$ prior time period. Consequently, the circular buffer stores the data from the X, Y and Z transducers for the (n) most recent time periods.

Figure 4:
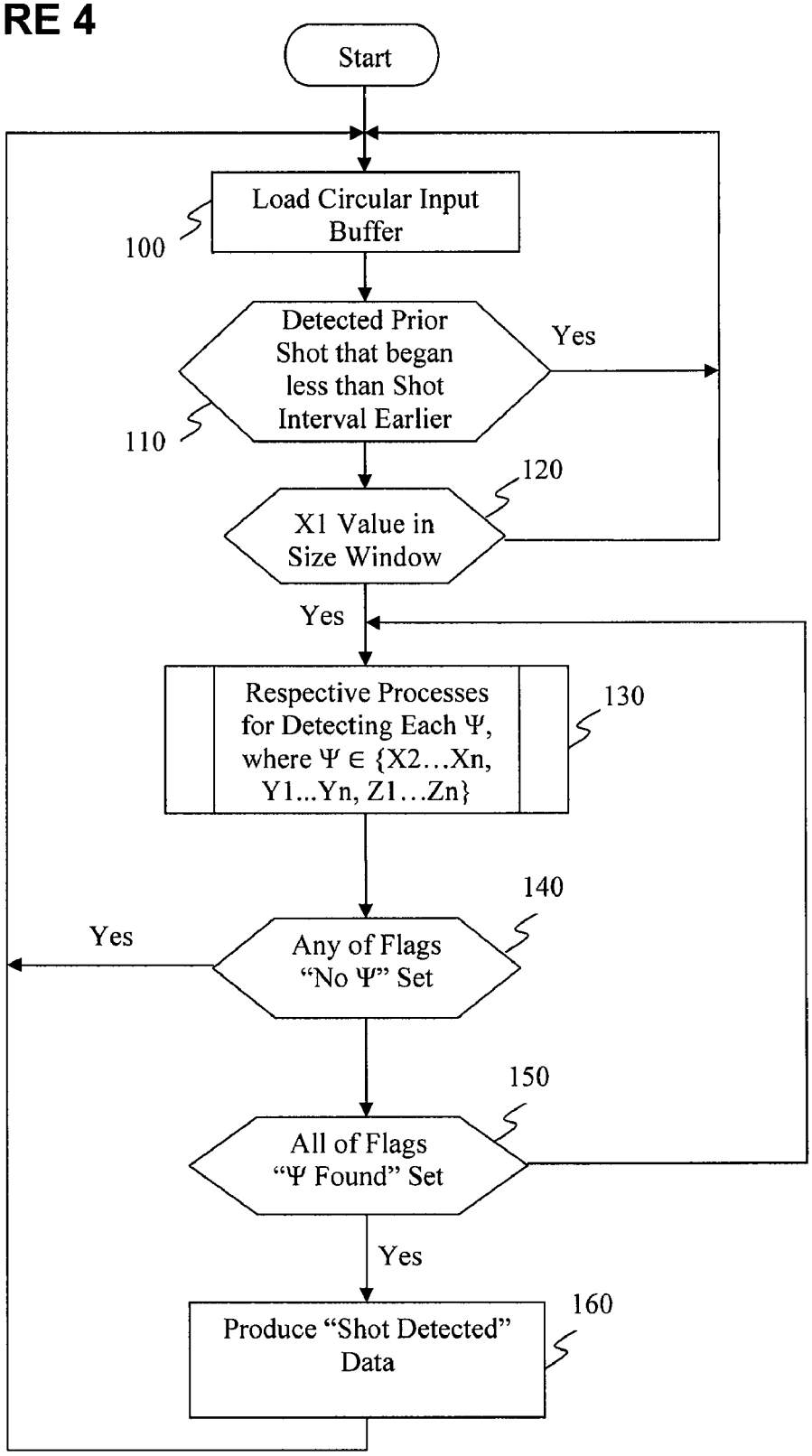

Processor 30 processes the data stored in the circular buffer to detect a shot made by the projectile weapon using instructions read from a program memory of the storage 40. FIG. 4 is a flow chart of a main module of an embodiment of a shot detection process implemented by a system such as that illustrated in FIG. 1. In this particular embodiment, the processor 30 continuously cycles through the process of FIG. 4 at least once during each time period during which new data from the X, Y and Z transducers is stored in the circular buffer, as indicated at 100 in FIG. 4. As indicated at 110, a prior detection of a shot by the processor 30 sets a shot interval flag that causes the processor 30 to loop back to the beginning of the process from 110 for a period of time counted from a beginning of the detected shot until the end of the shot interval. The shot interval is selected in certain embodiments based on a period of time following the beginning of a shot during which the projectile weapon will be unable to begin another shot. At the end of the shot interval following a detected shot, the flag is reset, so that the shot detection process is then carried out. By looping back to the beginning of the process during the shot interval, the process avoids executing needless operations and thus saves power.

Figure 5:
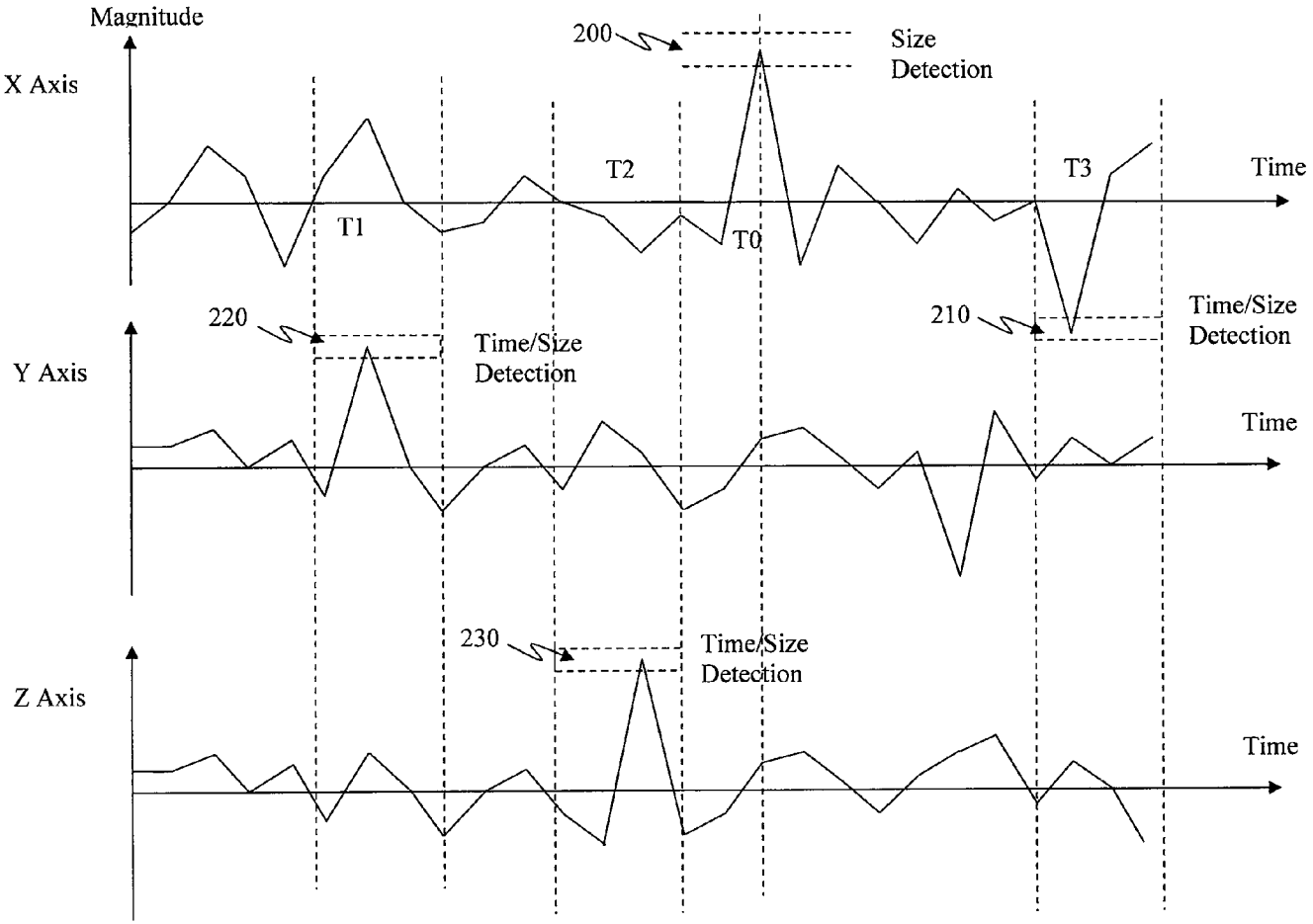

FIG. 5 provides hypothetical time charts of data produced by the X, Y and Z transducers and stored in the circular buffer. As indicated at 120 of FIG. 4, to detect a shot, and as a condition to further shot detection processing, the process examines the data stored in the circular buffer produced by the X transducer to detect a value X1 within a predetermined size window, shown as 200 in FIG. 5. If such a value is not found in data in the circular buffer for a currently-processed time window, the process loops back to 100 to load the buffer with additional data and increment a counter (not shown for purposes of simplicity and clarity) that stores data representing a next time period of the X transducer data to be examined at 120. As indicated in the hypothetical charts of FIG. 5, for a time period T0, the data produced by the X transducer falls within the predetermined size window 200. Consequently, when the X transducer data for time window T0 is examined at 120 of FIG. 4, processor 30 carries out 130 a number of predetermined processes for detecting one or more qualifying values Ψ at the same time period T0 or at one or more different time periods of the X, Y and Z transducer data. To detect a shot, all such qualifying values Ψmust be found.

Figure 6:
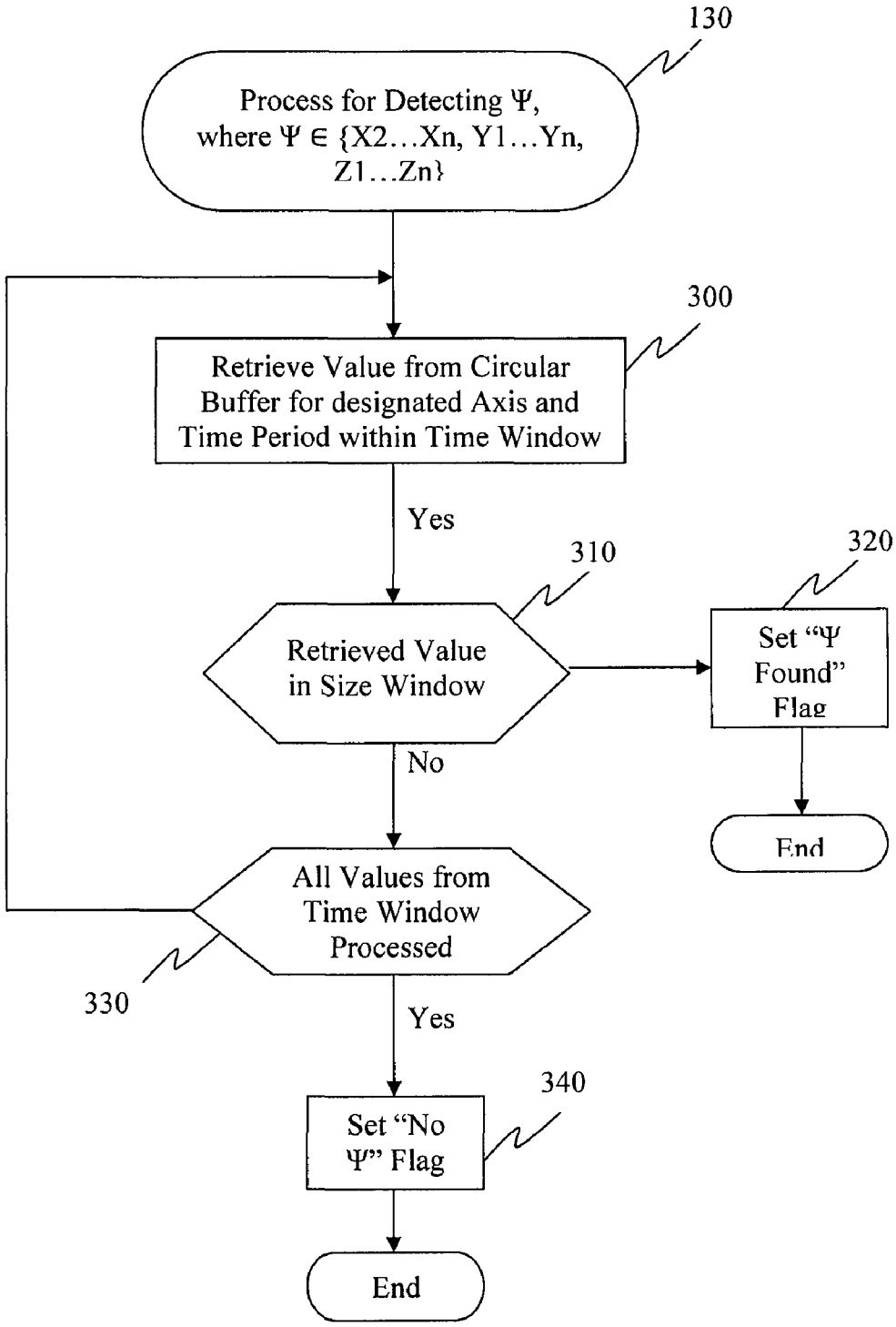
FIG. 6 illustrates a process as carried out by the embodiment of FIG. 1 for detecting each of a plurality of qualifying values necessary to detect a shot thereby.

The processes 130 are illustrated in FIG. 6. Essentially, each of the qualifying values Ψmust satisfy three criteria: (1) it must be measured by a particular one of the X, Y and Z transducers, (2) it must fall within a particular time period or time periods relative to the time period T0 of the X value detected in 120 of FIG. 4, and (3) it must fall within a predetermined size window. Accordingly, the criteria for detecting all of the qualifying values Ψcollectively comprise a signature for a true shot. The signature data is read by processor 30 from storage 30, either embedded in the instructions for the processes of FIGS. 4 and 6, or as one or more signature data sets.

FIG. 5 illustrates parameters for an exemplary process that requires the detection of three qualifying values in addition to the detection of the X transducer value in the size window 200 at time T0 as described above, in order to detect a shot. In this example, the three qualifying values include a value X2 measured by the X transducer along the X axis and falling within a time/size detection window 210, a value Y1 measured by the Y transducer along the Y axis and falling within a time/size detection window 220 and a value Z1 measured by the Z transducer along the Z axis and falling within a time-size detection window 230. If and only if all of these values have been detected, the processor 30 will detect a shot in this example.

FIG. 6 illustrates the process 130 as carried out for detecting each of the qualifying values. Accordingly, the process of FIG. 6 is carried out once for each such qualifying value to detect a shot, or until such time that any one such process fails to detect a qualifying value, in which case a shot is not detected. For detecting any respective one of the qualifying values, the processor 30 retrieves 300 a value from the circular buffer for the axis of such value and falling within a first time period within the time window for detection. If the processor 30 finds 310 that the retrieved value is within the size limits of the window, it sets 320 a flag "ΨFound" indicating that the respective qualifying value of Ψ has been detected, and this particular instance of the process 130 is terminated. If at 310 the process 30 determines that the retrieved value does not fall within the size window, it then determines 330 whether all values within the circular buffer falling within the time window have been processed. If not, processing returns to 300 and a further value is retrieved from the circular buffer. If so, the processor 30 sets 340 a "No Ψ" Flag and this instance of the process 130 is terminated. While the process 130 is able to accommodate processing within a time window encompassing more than one data time period, in certain embodiments, the time window only includes a single data time period, in which case the decision process 330 is unnecessary.

When each process 130 terminates, processor 30 returns to the main process illustrated in FIG. 4 and determines 140 whether any of the flags "No Ψ" has been set. If so, it is determined that a shot has not been detected and processing returns to 100 to load additional data in the circular buffer and search the circular buffer for another X1 value falling within the size window thus indicating a possible shot. If at 140 it is not found that any of the "No Ψ" flags has been set, then it is determined 150 whether all of the flags "ΨFound" have been set in the processes 130. If not, processing returns to a selected one of the processes 130 still running. If, however, it is found 150 that all of the flags "ΨFound" have been set, the processor 30 produces 160 shot detected data which it stores in storage 40 with a time and/or date stamp.

The output device 70 in certain embodiments comprises a display for providing shot information to a user of the projectile weapon, whether as one or more of (1) number of shots remaining in a magazine of the projectile weapon, (2) number of shots fired since a most resent rest of the system, (3) number of shots fired in a predetermined time period, (4) total number of shots fired during a lifetime of the projectile weapon, or otherwise. In certain embodiments, output device 70 comprises communications that serves to communicate shot detection data to a host or other processing system for storage or analysis. Such communicates may be implemented, for example, as a wireless IR-DA transceiver, a Bluetooth transceiver, a Zigbee transceiver, or the like. Such communications can, in the alternative, be implemented as a wired port, such as a USB, parallel or serial port, or the like.

In certain embodiments, the circular buffer is loaded in response to a timer interrupt, rather than as a process embedded in the main shot detection process. In this manner, the buffer can be filled continuously without carrying out any of the other processes of FIG. 4. In certain embodiments, the process 120 for detecting the value X1 falling within the predetermined size window is integrated with the interrupt driven process for loading the circular input buffer.

In certain embodiments, rather than search for a value from the X transducer to initiate the shot detection process, processor 30 searches for a value from either the Y transducer or the Z transducer. In certain embodiments, a total of six qualifying values are required for detecting a shot, two each from the X transducer, one having a positive sign and one a negative sign, two each from the Y transducer, one positive and one negative, and two each from the Z transducer, one positive and one negative.

In certain embodiments, storage 40 stores multiple data sets in order to store signatures comprising windowing data for each of a plurality of projectile weapons. When the system 20 is associated with a particular projectile weapon, it is configured to employ a signature previously stored therein corresponding to a group of which the particular projectile weapon is a member. For example, if the system is to be installed in an M16A4 rifle, it is configured electronically to use windowing data derived from the firing of one or more M16A4 rifles that provides a reliable basis for detecting that a true shot has been fired by that particular kind of weapon.

The windowing data for each type of projectile weapon is obtained by firing one or more such weapons and observing the corresponding data output by the two or more transducers of a system 20 mounted in a standard position on each such weapon or on a platform mounting the weapon. Several techniques are available for processing such data to remove noise. In one such technique, the data produced by firing multiple weapons of one kind under different conditions are averaged so that pulses in the data characterizing a shot are more readily distinguished from noise that is suppressed by averaging the data. In another such technique, characteristic pulses are detected by correlating multiple data sets produce by firing the weapons. Appropriate window sizes are derived by observing variations in the timing and amplitudes of the characteristic pulses.

In certain embodiments, variable numbers of qualifying values are employed to detect a shot depending on the type of projectile weapon being monitored and/or the platform on which it is mounted. In order to accommodate variable numbers of qualifying values to be detected, the processes of FIGS. 4 and 6 are implemented with instructions for carrying out $\Phi$ detection processes, where $\Phi$ is a natural number greater than or equal to the largest number of $\Psi$ detection processes 130 (FIG. 6) to be carried out for any projectile weapon whose signature (windowing data) is stored in storage 40.

Figure 7:
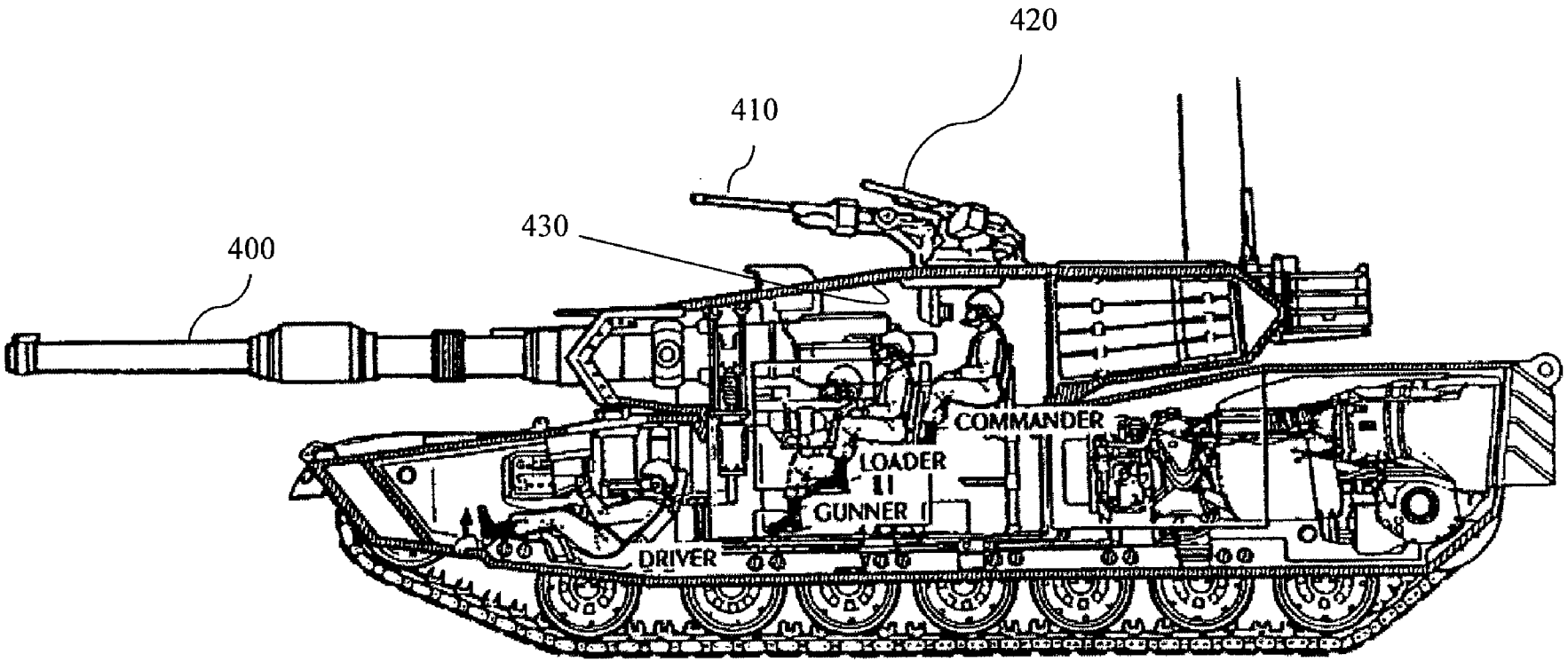
FIG. 7 illustrates an M1 Abrams tank mounting multiple projectile weapons to be monitored by systems of the kind illustrated in FIG. 1.

In certain embodiments, multiple systems 20 are mounted on a single weapons platform, and each of the systems 20 is configured to detect a shot by a specific one of multiple projectile weapons mounted on the weapons platform. As an example, FIG. 7 illustrates an M1 Abrams tank mounting a main gun 400, a 50 caliber machine gun 410 and a 7.62 mm machine gun 420, each of which produces characteristic accelerations of the weapons platform when it is fired. Three of the systems 20 (not shown for purposes of simplicity and clarity) are mounted on the tank, for example, on an interior wall of the turret 430, each of which is configured to detect the firing of a respective one of the guns 400, 410 and 420 and provide its shot detection data for the use of the tank's crew. As a further example, an M109 Self-Propelled Howitzer is illustrated in FIG. 8 having a main gun 500 and a 7.62 mm machine gun 510. Two of the systems 20 (not shown for purposes of simplicity and clarity) are mounted in the interior of the Self-Propelled Howitzer, each of which is configured to detect the firing of a respective one of the guns 500 and 510 and provide its shot detection data for the use of its crew.

FIG. 9 is a block diagram of a system 600 for recording data relating to a shot by an associated projectile weapon. System 600 comprises a processor 610, storage 620 coupled with processor 610, and two or more accelerometers 630 coupled with processor 610. Processor 610 servers to detect a shot by a projectile weapon using data received from accelerometers 630 and carrying out the shot detection processes described hereinabove in connection with FIGS. 1-8 according to instructions read from storage 620. Accordingly, the data provided by accelerometers 630 is stored in a circular buffer, which is either integrated with processor 610, or implemented by storage 620 which is coupled with processor 610, and may take the form of the circular buffer illustrated in FIG. 3 hereof. Processor 610 stores detected shot data in storage 620 in association with time stamp data representing a time and/or a date of occurrence of the detected shot and provided from a source of time stamp data 640, such as a clock circuit or a clock implemented by processor 610.

The system 600 also comprises one or more input devices 650 and a display 660 each coupled with processor 610. The one or more input devices in various embodiments of the system 600 include, but are not limited to, switches, keypads, touchpads, stylus-activated input devices, microphones and the like. Display 660 in various embodiments of system 600 comprises one or more of an LCD display, LED's, a plasma display, a CRT, a printer and the like. The input devices are employed by a user of system 600 to enter data and instructions in system 600, such as numbers of rounds in a magazine of the associated projectile weapon, data for setting the date and time, the type of associated projectile weapon to enable the system 600 to select an appropriate signature for use in shot detection, instructions for navigating through display screens afforded by system 600 via display 660, instructions for connecting the system 600 to a host or other device for uploading data or downloading software updates, setting power-consumption related parameters, such as display on-time interval, standby mode time threshold, power-off time threshold and display brightness level.

The standby mode of system 600 is a power saving mode in which the system performs such minimal tasks as may be necessary for enabling it to quickly switch to a fully operational mode. In the standby mode, inputs from one or more of the accelerometers 630 are received by processor 610 at a reduced sampling rate to detect movement of the system 600 and the associated projectile weapon, as a trigger for switching the system 600 to the fully operational mode for detecting a shot, as well as additional data, as explained in greater detail hereinbelow.

The power-off state is triggered on the condition that the system has been in the standby mode for a period of time exceeding the power-off time threshold.

In certain embodiments, system 600 implements an automatic brightness adjustment of the display 660 based on light intensity data received from a light sensor (not shown for purposes of simplicity and clarity).

System 600 also comprises data sensing/gathering devices that provide data representing the environment of the projectile weapon both prior to and after the detection of a shot by the projectile weapon. System 600 thus provides data that is very useful for purposes such as reconstruction of crime scenes and battlefield firefights. In certain embodiments, system 600 comprises one or more of a microphone 670 coupled with processor 610, an electronic compass 676 coupled with processor 610, a GPS receiver 682 coupled with processor 610 and a video camera 688 coupled with processor 610.

In certain ones of such embodiments, data from microphone 670 is stored by processor 610 in a circular buffer, which is either integrated with processor 610, or implemented by storage 620 which is coupled with processor 30, and is either combined with or separate from the circular buffer which serves to store the data from accelerometers 630. The data from microphone 670 is associated with time stamp data from source 640, so that it may be matched in time with the data produced by accelerometers 630, as well as with a shot detected by processor 610 by processing the acceleration data. Since the microphone data is stored in a circular buffer, the oldest data in the buffer is overwritten by presently received data, so that only the last Γ seconds or minutes are retained in the circular buffer at any given time. In certain ones of such embodiments, the circular buffer stores the last Γ seconds or minutes of data produced by microphone 670, where Γ is selected to provide a sufficient record to reconstruct events prior to the detected shot. In various ones of such embodiments, Γ is selected as 10 seconds, 20 seconds, 30 seconds, one minute, five minutes or any other practical and desired period of time. In response to the detection of a shot, it either reads the microphone data in the circular buffer (or else a portion of it) and stores a record of it in storage 620 with time stamp data matching it to the shot detection data in time, or else labels the data presently stored in the circular buffer as a record matched in time with a shot, and begins a new circular buffer for the microphone data at a different location in storage 620. In certain ones of such embodiments, not only microphone data which occurred prior to the shot, but also microphone data occurring thereafter is stored. In certain ones of such embodiments, the acceleration data for the last Γseconds or minutes, or a different time period preceding the detected shot, is also stored either as a record in storage 620 with time stamp data matching it to the shot detection data in time, or else labels the data presently in the circular buffer containing the acceleration data as a record matched in time with the shot. In certain ones of such embodiments, not only acceleration data which occurred prior to the shot, but also acceleration data occurring thereafter is stored. Subsequently, the records including the microphone and/or acceleration data are transferred by communications of system 600 (not shown for purposes of simplicity and clarity) along with the shot detection data to a host or other processing system for evaluating the events which occurred at the time of the shot. Such communications can be implemented in any of the ways explained above in connection with output device 70 of FIG. 1.

In certain embodiments, storage 620 stores audio signature data representing audio data corresponding to a shot by the projectile weapon. The signature data may comprise, for example, amplitude and/or timing data characteristic of a shot by the projectile weapon. In such embodiments, corresponding signature data is extracted from the microphone data and matched to the stored audio signature data either to detect a shot, or to confirm a shot detected with the use of acceleration data. In certain embodiments, the system 600 comprises an optical sensor mounted to detect muzzle flash by a projectile weapon in the form of a firearm, and stores signature data representing a characteristic signal produced by the optical sensor in response to muzzle flash produced by a shot made with the firearm. In such embodiments, corresponding signature data is extracted from the signal output by the optical sensor and matched to the stored signature data either to detect a shot, or to confirm a shot detected with the use of acceleration data. In certain embodiments, the system 600 comprises a thermal sensor mounted to detect heat produced by a shot by a firearm, and stores signature data representing a characteristic signal produced by the thermal sensor when a shot is made by the firearm. In such embodiments, corresponding signature data is extracted from the signal output by the thermal sensor and matched to the stored signature data either to detect a shot, or to confirm a shot detected with the use of acceleration data. In certain embodiments, the system 600 comprises a strain gauge mounted to detect strain produced by a shot by a projectile weapon, and stores signature data representing a characteristic signal produced by the strain gauge when a shot is made by the projectile weapon. In such embodiments, corresponding signature data is extracted from the signal output by the strain gauge and matched to the stored signature data either to detect a shot, or to confirm a shot detected with the use of acceleration data.

In certain ones of such embodiments, data from electronic compass 676, from the GPS receiver 682 and/or the video camera 688 is stored by processor 610 in one or more circular buffers, either the same as that which stores the accelerometer data and/or the microphone data, or implemented separately. This electronic compass data indicates the compass direction of the projectile weapon for the Γ seconds or minutes, or a different time period, preceding a current time. This GPS receiver data indicates a location of the projectile weapon for the Γ seconds or minutes, or a different time period, preceding a current time, and the data from the video camera 688 provides moving images produced by the video camera (which may be pointed, for example, down the barrel of the projectile weapon towards its muzzle end) for the Γ seconds or minutes, or a different time period, preceding a current time. Like the microphone data, when the processor 610 detects a shot, it causes the data from the electronic compass 676, the GPS receiver 682 and/or the video camera 688 that has been stored in the circular buffer (or a portion of it) to be retained along with time stamp data matching it to the shot detection data in time. Subsequently, the records including the electronic compass data, GPS data and/or the video data are transferred by the communications of the system 600 along with the shot detection data to a host or other processing system. It will be seen that the accelerometers 630, the microphone 670, the electronic compass 676, the GPS receiver 682 and the video camera 688 each provides data related to an environment of the projectile weapon that is useful for evaluating the events which occurred at the time of a shot.

Although various embodiments have been described with reference to a particular arrangement of parts, features and the like, these are not intended to exhaust all possible arrangements or features, and indeed many other embodiments, modifications and variations will be ascertainable to those of skill in the art.

What is claimed is:

1. A process for recording data relating to a shot by a projectile weapon, comprising:

temporarily storing in storage environment data related to an environment of the projectile weapon associated with time data representing a time of occurrence of the environment data;

removing the temporarily-stored environment data from the storage associated with a time of occurrence that is more than a predetermined time period older than a current time;

receiving shot data representing a shot made by the projectile weapon; and in response to the shot data, storing a record of at least a portion of the temporarily-stored environment data longer than the predetermined time period.

2. The process of claim 1, wherein storing a record of at least a portion of the temporarily-stored environment data comprises storing data indicating that the temporarily-stored environment data is to be stored longer than the predetermined time period.

3. The process of claim 1, wherein storing a record of at least a portion of the temporarily-stored environment data comprises transferring at least a portion of the temporarily-stored environment data to a longer-term storage location from a shorter-term memory location.

4. The process of claim 1, wherein the environment data comprises data representing orientations of the projectile weapon.

5. The process of claim 1, wherein the environment data comprises data representing locations of the projectile weapon.

6. The process of claim 1, wherein the environment data comprises data representing ambient sounds.

7. The process of claim 1, wherein the environment data comprises data representing movement of the projectile weapon.

8. The process of claim 1, wherein the environment data comprises data representing acceleration of the projectile weapon.

9. A system for recording data relating to a shot by a projectile weapon, comprises:

at least one input;

a processor coupled to the at least one input to receive environment data related to an environment of the projectile weapon; and storage;

the processor being configured to temporarily store the environment data in the storage associated with time data representing a time of occurrence of the environment data; to remove the temporarily-stored environment data from the storage associated with a time of occurrence that is more than a predetermined time period older than a current time; to receive shot data representing a shot made by the projectile weapon from the at least one input; and in response to the shot data, store a record of at least a portion of the temporarily-stored environment data in the storage longer than the predetermined time period.

* * * * *